United States Patent [19]

Suzuki et al.

[11] 4,282,163

[45] Aug. 4, 1981

[54] METHOD OF PRODUCING HYDROGENATED FATTY ACIDS

[75] Inventors: Masao Suzuki, Nishinomiya; Takeshi Matsuo; Naomichi Yamada, both of Amagasaki, all of Japan

[73] Assignee: Nippon Oil and Fats Co., Ltd., Japan

[21] Appl. No.: 102,533

[22] Filed: Dec. 11, 1979

[30] Foreign Application Priority Data

Dec. 19, 1978 [JP] Japan ..... 53-157101

[51] Int. Cl.[3] ..... C11C 3/12

[52] U.S. Cl. ..... 260/409; 260/419

[58] Field of Search ..... 260/409, 419

[56] References Cited

U.S. PATENT DOCUMENTS

| | | | |
|---|---|---|---|
| 1,247,516 | 11/1917 | Ellis | 260/409 |
| 1,927,850 | 9/1933 | Schellmann et al. | 260/409 |
| 2,862,943 | 12/1958 | Wheeler | 260/419 |
| 3,197,418 | 7/1965 | Maebashi | 260/409 |
| 3,896,053 | 7/1975 | Broecker et al. | 260/409 |
| 4,163,750 | 8/1979 | Bird et al. | 260/409 |
| 4,179,454 | 12/1979 | Mehta et al. | 260/409 |

*Primary Examiner*—John F. Niebling

*Attorney, Agent, or Firm*—Stevens, Davis, Miller & Mosher

[57] ABSTRACT

Hydrogenated fatty acid having excellent color and stability can be obtained by hydrogenating fatty acid; oil or fat, and distilling the crude hydrogenated fatty acid; or splitting the hydrogenated oil or fat into crude hydrogenated fatty acid and distilling the crude hydrogenated fatty acid.

10 Claims, No Drawings

METHOD OF PRODUCING HYDROGENATED FATTY ACIDS

BACKGROUND OF THE INVENTION (1) Field of the Invention

The present invention relates to a method of producing hydrogenated fatty acids having excellent color and stability.

(2) Description of the Prior Art

Hydrogenated fatty acid can be obtained by splitting oil or fat into fatty acid and hydrogenating the fatty acid; or hydrogenating oil or fat into hardened oil or fat and splitting the hardened oil or fat. It is commonly known that when fatty acid, oil or fat is hydrogenated, the hydrogenated fatty acid, oil or fat is less in the coloration and in the smell than the original fatty acid, oil or fat. However, the hydrogenated fatty acid, oil and fat are easily colored or oxidized when they are heated or used in a chemical reaction, and even when the hydrogenated fatty acid is distilled, the distilled hydrogenated fatty acid is still insufficient in the stability.

The inventors have made various investigations in order to obtain hydrogenated fatty acid having excellent color and stability in the heating and chemical reaction, and found out that the above described object can be attained by hydrogenating fatty acid, oil or fat in the presence of a hydrogenation catalyst and a reducing metal, and distilling the crude hydrogenated fatty acid; or splitting the hydrogenated oil or fat into a crude hydrogenated fatty acid, and distilling the crude hydrogenated fatty acid.

The inventors have made further investigations and found out that, when the above described hydrogenation is carried out in the presence of a hydrogenation catalyst, a reducing metal and at least one of boric acid compound and heavy phenolic compound, the hydrogenated fatty acid has lighter color and improved stability.

SUMMARY OF THE INVENTION

One of the features of the present invention is to provide a method of producing hydrogenated fatty acids, comprising hydrogenating a fatty acid, oil or fat in the presence of a hydrogenation catalyst and a reducing metal, and distilling the crude hydrogenated fatty acid; or splitting the hydrogenated oil or fat into a crude hydrogenated fatty acid, and distilling the crude hydrogenated fatty acid.

Another feature of the present invention is to provide a method of producing hydrogenated fatty acids, comprising hydrogenating a fatty acid, oil or fat in the presence of a hydrogenation catalyst, a reducing metal and at least one of boric acid compound and heavy phenolic compound, and distilling the crude hydrogenated fatty acid; or splitting the hydrogenated oil or fat into a crude hydrogenated fatty acid, and distilling the crude hydrogenated fatty acid.

DESCRIPTION OF THE PREFERRED EMBODIMENT

The oils and fats to be applied to the present invention include animal and vegetable oils and fats and fish oils, such as beef tallow, lard, mutton tallow, soybean oil, rice bran oil, palm oil, tall oil, rapeseed oil, cottonseed oil, coconut oil, whale oil, sardine oil and the like, and acid oils formed as a by-product in the purification of these oils and fats.

The fatty acid to be applied to the present invention includes fatty acids obtained from the above described oils and fats, and further includes oleic acid, linoleic acid, linolenic acid, lauric acid, palmitic acid, stearic acid, etc., which are obtained by the solvent or hydrophilization separation or by the fractional distillation of the above described fatty acids obtained from oils and fats. Further, synthetic fatty acids obtained by paraffin oxidation process, oxo process, oxidative cleavage process, skeletal isomerization process and th like can be applied to the present invention.

As the hydrogenation catalyst, there can be used catalysts commonly used in the hydrogenation of organic compound. These catalysts include metals, such as iron, cobalt, nickel, ruthenium, rhodium, palladium, osmium, iridium, platinum, chromium, molybdenum, tungsten, copper, rhenium, vanadium and the like; and their alloys, oxides, hydroxides, sulfides and the like; and are, for example, palladium black, palladium on carbon, platinum oxide, nickel on kieselguhr, Raney nickel, Raney iron, Raney copper, copper chromite, molybdenum sulfide and the like.

As the reducing metal, there are used magnesium, calcium, aluminum, zinc, tin and the like, and their alloys having no catalytic activity for hydrogenation.

As the boric acid compound, there are used orthoboric acid, metaboric acid, tetraboric acid, boron oxide, and esters and salts of the above described boric acids.

As the phenolic compound to be used in the present invention, heavy phenolic compounds having a high thermal resistance and further having a boiling point higher than that of hydrogenated fatty acid are preferable. The heavy phenolic compounds include, for example, tetrakis[methylene-(3,5-di-t-butyl-4-hydroxyhydrocinnamate)]methane, (3,5-di-t-butyl-4-hydroxyhydrocinnamate)]methane, 4,4'-butylidenebis(3-methyl-6-t-butylphenol), octadecyl 3,5-di-t-butyl-4-hydroxyhydrocinnamate, 4,4'-methylenebis(2,6-di-t-butylphenol), 2,6-bis(1-methylheptadecyl)-4-methylphenol, 1,3,5-trimethyl-2,4,6-tris(3,5-di-t-butyl-4-hydroxybenzyl)benzene, 1,1,3-tris(2-methyl-4-hydroxy-5-t-butylphenyl)butane, 4,4'-cyclohexylidenebis(2-cyclohexylphenol), 2-t-butyl-$\alpha$-(3-t-butyl-4-hydroxyphenyl)-p-cumenylbis(p-nonylphenyl)phosphite, 2,2'-methylenebis[6-(1-methylcyclohexyl)-p-cresol], 1,6-hexane diol-bis-3-(3,5-di-t-butyl-4-hydroxyphenyl)propionate, 2,4-bis(n-octylthio)-6-(4-hydroxy-3,5-di-t-butylanilino)-1,3,5-triazine, 2,2'-thiodiethylbis[3-(3,5-di-t-butyl-4-hydroxyphenyl)-propionate], O,O-di-n-octadecyl 3,5-di-t-butyl-4-hydroxybenzylphosphonate, N,N'-hexamethylenebis(3,5-di-t-butyl-4-hydroxyhydrocinnamamide) and the like. These heavy phenolic compounds are ones generally used as an oxidation inhibitor.

The use amount of the hydrogenation catalyst is not particularly limited, but the hydrogenation catalyst is preferably used in an amount of 0.01–5% by weight based on the amount of raw fatty acid, oil and fat.

The use amount of the reducing metal and boric acid compound also is not particularly limited due to the reason that the optimum amount varies depending upon the kind and quality of raw fatty acid, oil and fat. However, each of the reducing metal and boric acid compound is preferably used in an amount of 0.01–2% by weight based on the amount of raw fatty acid, oil and fat. When the amount is less than 0.01%, the effect of the reducing metal and boric acid compound is poor, while even when the amount exceeds 2% by weight, the effect does not so improve, and the distillation residue rather increases. Particularly, when more than 2% by weight of boric acid compound is used, the hydrogenation catalyst is poisoned.

The heavy phenolic compound is preferably used in an amount of 0.001–1.0% by weight based on the amount of raw fatty acid, oil and fat. When the amount of the heavy phenolic compound is less than 0.001% by weight, the effect of the heavy phenolic compound is poor, while even when the amount exceeds 1.0% by weight, the effect does not so improve. The heavy phenolic compound does not poison at all the hydrogenation catalyst in the use of 0.001–1.0% by weight.

The hydrogenation catalyst hydrogenates the double bond in the raw fatty acid, oil and fat, and further hydrogenates colored or coloring impurities, such as carbonyl compound, hydroxyl compound, epoxy compound, phenolic compound and the like, contained in the raw fatty acid, oil and fat.

The reducing metal probably reduces the above described colored or coloring impurities, and further adsorbs poisonous substances for the hydrogenation catalyst or converts the poisonous substances into non-poisonous substances to improve the hydrogenation effect of the hydrogenation catalyst. The use of a large amount of boric acid compound poisons the hydrogenation catalyst, but when the boric acid compound is used in combination with the reducing metal, the poisoning action of the boric acid compound does not appear and further the filterability of the hydrogenation catalyst is improved. Substantially all the reducing metal is finally converted into fatty acid salt, and the fatty acid salt can be removed by filtration or in the form of distillation residue in the distillation.

Further, the boric acid compound probably reacts with the above described colored or coloring impurities, and further reacts with coloring and ill-smelling hydroxyl compound formed by the reduction of carbonyl compound and the like during the hydrogenation, whereby these impurities are converted into high boiling point substances capable of being removed in the form of distillation residue.

The heavy phenolic compound probably converts primary oxidation compound contained in the raw fatty acid, oil and fat, that is, precursors of oxygen-containing impurities which consist mainly of carbonyl compounds, such as hydroperoxide and the like, into inert compounds through a non-radical reaction, and further inhibits the new development of these precursors during the splitting of the hydrogenated oil and fat and during the distillation of the crude hydrogenated fatty acid.

In the present invention, the hydrogenation of fatty acid, oil and fat can be carried out in the exactly same manner as that in the hydrogenation of ordinary oils and fats. That is, a fatty acid, oil or fat is hydrogenated at a temperature from room temperature to 300° C. under a hydrogen atmosphere in the presence of a hydrogenation catalyst and a reducing metal and occasionally at least one of boric acid compound and heavy phenolic compound. The hydrogenation may be carried out until substantially all double bonds have been hydrogenated, or may be stopped at the stage wherein a part of double bonds have been hydrogenated.

The crude hydrogenated fatty acid is then subjected to distillation. However, when oil or fat is hydrogenated, the hydrogenated oil or fat is splitted into a crude hydrogenated fatty acid, and the crude hydrogenated fatty acid is subjected to distillation. The splitting of hydrogenated oil or fat into crude hydrogenated fatty acid can be carried out by any of thermal pressure splitting process or saponification process.

The hydrogenation catalyst and reducing metal used in the hydrogenation are removed by filtration or removed in the form of distillation residue. The boric acid compound and heavy phenolic compound used in the hydrogenation are removed in the form of distillation residue together with impurities formed into high boiling point substances. Accordingly, a hydrogenated fatty acid having excellent color and stability can be obtained by hydrogenating a fatty acid, oil or fat in the presence of a hydrogenation catalyst and a reducing metal, and occasionally at least one of boric acid compound and heavy phenolic compound, and distilling the crude hydrogenated fatty acid; or splitting the hydrogenated oil or fat into a crude hydrogenated fatty acid, and distilling the crude hydrogenated fatty acid.

The hydrogenated fatty acid obtained in the present invention is excellent in the color stability not only against heat and oxidation, but also against acidic and basic reagents.

The following examples are given for the purpose of illustration of this invention and are not intended as limitations thereof.

In the examples, a method for hydrogenating a fatty acid, oil or fat in the presence of a hydrogenation catalyst and a reducing metal is referred to as "Method A", that in the presence of a hydrogenation catalyst, a reducing metal and a boric acid compound is referred to as "Method B", that in the presence of a hydrogenation catalyst, a reducing metal and a heavy phenolic compound is referred to as "Method C", and that in the presence of a hydrogenation catalyst, a reducing metal, a boric acid compound and a heavy phenolic compound is referred to as "Method D".

In the distillation of crude hydrogenated fatty acid in the following examples, a fraction up to a bottom temperature of 230° C. under 1 mmHg was gathered. However, in Example 5, a fraction up to a bottom temperature of 150° C. under 1 mmHg was gathered.

Further, "%" of the amount of the reagents used in the hydrogenation in the following examples means % by weight based on the amount of raw fatty acid, oil and fat.

EXAMPLE 1

To crude tallow fatty acid having a neutralization value of 200.4 and an iodine value of 65.6 were added 0.1% of tin powder, 0.1% of orthoboric acid, 0.005% of 2,2'-thiodiethylbis[3-(3,5-di-t-butyl-4-hydroxyphenyl)-propionate] and 0.6% of a hydrogenation catalyst of nickel-hardened fat (nickel catalyst dispersed in hardened fat), and the resulting mixture was stirred at 200° C. for 3 hours under a hydrogen pressure of 30 kg/cm$^2$. The reaction mass was filtered, and the filtrate was distilled to obtain hydrogenated tallow fatty acid according to Method D of the present invention.

Further, the same crude tallow fatty acid as described above was treated in the same manner as described above, except that the crude tallow fatty acid was hydrogenated in the presence of 0.6% of nickel-hardened fat alone as Comparative method, in the presence of 0.6% of nickel-hardened fat and 0.1% of tin powder as Method A, in the presence of 0.6% of nickel-hardened fat, 0.1% of tin powder and 0.1% of orthoboric acid as Method B, and in the presence of 0.6% of nickel-hardened fat, 0.1% of tin powder and 0.005% of 2,2'-thiodiethylbis[3-(3,5-di-t-butyl-4-hydroxyphenyl)propionate] as Method C, to obtain hydrogenated tallow fatty acids.

The analytical data and the result of stability test of the resulting hydrogenated tallow fatty acids are shown in the following Table 1.

TABLE 1

| Item | Comparative method | Method A | Method B | Method C | Method D |
|---|---|---|---|---|---|
| (1) Iodine value (Wijs) | 0.6 | 0.5 | 0.5 | 0.5 | 0.5 |
| (2) Color (APHA) | 140 | 90 | 40 | 90 | 40 |
| (3) Heat color stability (APHA) | 250 | 170 | 80 | 160 | 80 |
| (4) Thermal oxidation color stability (APHA) | 400 | 250 | 150 | 250 | 140 |
| (5) Base color stability (APHA) | 250 | 180 | 140 | 170 | 130 |
| (6) Acid color stability (Gardner) | 7 | 5 | 4 | 4–5 | 3–4 |
| (7) Oxidation stability (POV) | 21.7 | 20.2 | 19.8 | 1.3 | 1.2 |

Note:
A sample having a larger color value colors more noticeably and is poorer in the quality.

The test items (3)–(7) in above Table 1 and the following tables are as follows.

Item (3) shows the color stability of hydrogenated fatty acid against heat. A color value of a hydrogenated fatty acid is measured after the fatty acid is heated at 205° C. for 1 hour under nitrogen atmosphere.

Item (4) shows the color stability of hydrogenated fatty acid against thermal oxidation. A color value of a hydrogenated fatty acid is measured after the fatty acid is heated at 150° C. for 3 hours under the air.

Item (5) shows the color stability of hydrogenated fatty acid against alkaline reagent. A color value of a hydrogenated fatty acid is measured after the fatty acid is heated at 150° C. for 2 hours together with equimolar amount of diethanolamine under stirring by gaseous nitrogen.

Item (6) shows the color stability of hydrogenated fatty acid against acidic reagent. A color value of a hydrogenated fatty acid is measured after the fatty acid is heated at 205° C. for 1 hour together with 0.1% of paratoluenesulfonic acid while stirring by gaseous nitrogen, and then left to stand to be cooled for 1 hour at room temperature.

Item (7) shows the stability of hydrogenated fatty acid against oxidation. A peroxide value (m eq./kg) of a hydrogenated fatty acid is measured after 200 g of the fatty acid is charged in a 500 ml beaker and left to stand for 10 days in an oven kept at 80° C.

Further, 200 g of each of the above obtained hydrogenated tallow fatty acids was charged in a 500 ml beaker and thermally deteriorated for 10 days in an oven kept at 80° C. Thus treated fatty acids were subjected to the same stability tests as described above, and the obtained result is shown in the following Table 2.

TABLE 2

| Item | Comparative method | Method A | Method B | Method C | Method D |
|---|---|---|---|---|---|
| (2) Color (APHA) | 250 | 190 | 130 | 140 | 90 |
| (3) Heat color stability (APHA) | >500 (Gardner: 5) | 500 | 400 | 250 | 160 |
| (4) Thermal oxidation color stability (APHA) | >500 (Gardner: 5) | 500 | 350 | 300 | 180 |
| (5) Base color stability (Gardner) | 9 | 8 | 7 | 2–3 | 2 |
| (6) Acid color stability (Gardner) | 11 | 9–10 | 8 | 6 | 5 |

EXAMPLE 2

To crude palm acid oil fatty acid having a neutralization value of 201.4 and an iodine value of 56.0 were added 0.1% of zinc powder, 0.1% of boron oxide, 0.005% of N,N'-hexamethylenebis(3,5-di-t-butyl-4-hydroxyhydrocinnamamide) and 0.5% of a hydrogenation catalyst of nickel on kieselguhr, and the resulting mixture was stirred at 200° C. for 3 hours under a hydrogen pressure of 30 kg/cm$^2$. The reaction mass was filtered, and the filtrate was distilled to obtain hydrogenated palm acid oil fatty acid according to Method D of the present invention.

Further, the same crude palm acid oil fatty acid as described above was treated in the same manner as described above, except that the crude palm acid oil fatty acid was hydrogenated in the presence of 0.5% of nickel on kieselguhr alone as Comparative method, in the presence of 0.5% of nickel on kieselguhr and 0.1% of zinc powder as Method A, in the presence of 0.5% of nickel on kieselguhr, 0.1% of zinc powder and 0.1% of boron oxide as Method B, and in the presence of 0.5% of nickel on kieselguhr, 0.1% of zinc powder and 0.005% of N,N'-hexamethylenebis(3,5-di-t-butyl-4-hydroxyhydrocinnamamide) as Method C, to obtain hydrogenated palm acid oil fatty acids.

The analytical data and the result of stability test of the resulting hydrogenated palm acid oil fatty acids are shown in the following Table 3.

TABLE 3

| Item | Comparative method | Method A | Method B | Method C | Method D |
|---|---|---|---|---|---|
| (1) Iodine value (Wijs) | 0.8 | 0.7 | 0.7 | 0.7 | 0.7 |
| (2) Color (APHA) | 160 | 110 | 60 | 110 | 60 |
| (3) Heat color stability (APHA) | 250 | 180 | 100 | 180 | 100 |

TABLE 3-continued

| Item | Comparative method | Method A | Method B | Method C | Method D |
|---|---|---|---|---|---|
| (4) Thermal oxidation color stability (APHA) | >500 (Gardner: 3-4) | 400 | 200 | 350 | 180 |
| (5) Base color stability (APHA) | 250 | 190 | 120 | 170 | 110 |
| (6) Acid color stability (Gardner) | 5 | 4 | 3 | 3-4 | 2-3 |
| (7) Oxidation stability (POV) | 24.8 | 23.1 | 22.7 | 1.9 | 1.8 |

Further, 200 g of each of the above obtained hydrogenated palm acid oil fatty acids was charged in a 500 ml beaker and thermally deteriorated for 10 days in an oven kept at 80° C. The above treated fatty acids were subjected to the same stability tests as described above, and the obtained result is shown in the following Table 4.

TABLE 4

| Item | Comparative method | Method A | Method B | Method C | Method D |
|---|---|---|---|---|---|
| (2) Color (APHA) | 350 | 300 | 200 | 180 | 130 |
| (3) Heat color stability (Gardner) | 5 | 4-5 | 3-4 | 2-3 | 1-2 |
| (4) Thermal oxidation color stability (Gardner) | 5 | 4 | 3-4 | 3 | 1-2 |
| (5) Base color stability (Gardner) | 9 | 8 | 7 | 2-3 | 1-2 |
| (6) Acid color stability (Gardner) | 10 | 8-9 | 7-8 | 4-5 | 3-4 |

EXAMPLE 3

To crude lard having an acid value of 4.8 and an iodine value of 67.4 were added 0.1% of calcium-zinc alloy powder, 0.1% of tetraboric acid, 0.01% of 4,4'-butylidenebis(3-methyl-6-t-butylphenol) and 0.5% of a hydrogenation catalyst of nickel-hardened fat, and the resulting mixture was stirred at 200° C. for 3 hours under a hydrogen pressure of 30 kg/cm$^2$. The reaction mass was filtered, the filtrate was hydrolysed at 250° C. under a pressure of 50 atm., and the resulting splitted hydrogenated fatty acid was distilled to obtain hydrogenated lard fatty acid according to Method D of the present invention.

Further, the same crude lard as described above was treated in the same manner as described above, except that the crude lard was hydrogenated in the presence of 0.5% of nickel-hardened fat alone as Comparative method, in the presence of 0.5% of nickel-hardened fat and 0.1% of calcium-zinc alloy powder as Method A, in the presence of 0.5% of nickel-hardened fat, 0.1% of calcium-zinc alloy powder and 0.1% of tetraboric acid as Method B, and in the presence of 0.5% of nickel-hardened fat, 0.1% of calcium-zinc alloy powder and 0.01% of 4,4'-butylidenebis(3-methyl-6-t-butylphenol) as Method C, to obtain hydrogenated lard fatty acids.

The analytical data and the result of stability test of the resulting hydrogenated lard fatty acids are shown in the following Table 5.

TABLE 5

| Item | Comparative method | Method A | Method B | Method C | Method D |
|---|---|---|---|---|---|
| (1) Iodine value (Wijs) | 0.4 | 0.3 | 0.3 | 0.3 | 0.3 |
| (2) Color (APHA) | 100 | 80 | 40 | 70 | 30 |
| (3) Heat color stability (APHA) | 190 | 130 | 80 | 110 | 70 |
| (4) Thermal oxidation color stability (APHA) | 200 | 150 | 110 | 140 | 100 |
| (5) Base color stability (APHA) | 250 | 160 | 110 | 150 | 90 |
| (6) Acid color stability (Gardner) | 5 | 3-4 | 2-3 | 3 | 2 |
| (7) Oxidation stability (POV) | 18.7 | 17.0 | 16.2 | 1.6 | 1.4 |

Further, 200 g of each of the above obtained hydrogenated lard fatty acids was charged in a 500 ml beaker and thermally deteriorated for 10 days in an oven kept at 80° C. The above treated fatty acids were subjected to the same stability tests as described above, and the obtained result is shown in the following Table 6.

TABLE 6

| Item | Comparative method | Method A | Method B | Method C | Method D |
|---|---|---|---|---|---|
| (2) Color (APHA) | 200 | 160 | 130 | 130 | 90 |
| (3) Heat color stability (APHA) | 500 | 400 | 350 | 250 | 180 |
| (4) Thermal oxidation color stability (APHA) | >500 (Gardner: 3-4) | 400 | 300 | 250 | 190 |
| (5) Base color stability (Gardner) | 7-8 | 6-7 | 5 | 3 | 2 |
| (6) Acid color stability (Gardner) | 8 | 7 | 6 | 4 | 3 |

EXAMPLE 4

To commercial stearic acid having a neutralization value of 203.1 and an iodine value of 2.6 were added 0.05% of magnesium powder and 0.3% of tin powder as a reducing metal, and further added 0.1% of orthoboric acid, 0.1% of O,O-di-n-octadecyl 3,5-di-t-butyl-4-hydroxybenzylphosphonate and 0.2% of a hydrogenation catalyst of palladium on carbon, and the resulting mixture was stirred at 180° C. for 3 hours under a hydrogen pressure of 5 kg/cm$^2$. The reaction mass was filtered, and the filtrate was distilled to obtain hydrogenated stearic acid according to Method D of the present invention.

Further, the same commercial stearic acid as described above was treated in the same manner as described above, except that the commercial stearic acid was hydrogenated in the presence of 0.2% of palladium on carbon alone as Comparative method, in the presence of 0.2% of palladium on carbon, 0.05% of magnesium powder and 0.3% of tin powder as Method A, in the presence of 0.2% of palladium on carbon, 0.05% of magnesium powder, 0.3% of tin powder and 0.1% of orthoboric acid as Method B, and in the presence of 0.2% of palladium on carbon, 0.05% of magnesium powder, 0.3% of tin powder and 0.1% of O,O-di-n-octadecyl 3,5-di-t-butyl-4-hydroxybenzylphosphonate as Method C, to obtain hydrogenated stearic acids.

The analytical data and the result of stability test of the resulting hydrogenated stearic acids are shown in the following Table 7.

TABLE 7

| Item | Comparative method | Method A | Method B | Method C | Method D |
|---|---|---|---|---|---|
| (1) Iodine value (Wijs) | 1.5 | 1.4 | 1.5 | 1.4 | 1.4 |
| (2) Color (APHA) | 190 | 120 | 70 | 120 | 70 |
| (3) Heat color stability (APHA) | 400 | 250 | 150 | 250 | 140 |
| (4) Thermal oxidation color stability (APHA) | 500 | 300 | 200 | 300 | 190 |
| (5) Base color stability (APHA) | 450 | 300 | 200 | 250 | 190 |
| (6) Acid color stability (Gardner) | 8 | 6 | 5 | 5–6 | 4 |
| (7) Oxidation stability (POV) | 25.3 | 25.1 | 24.9 | 1.8 | 1.7 |

Further, 200 g of each of the above obtained hydrogenated stearic acids was charged in a 500 ml beaker and thermally deteriorated for 10 days in an oven kept at 80° C. The above treated fatty acids were subjected to the same stability tests as described above, and the obtained result is shown in the following Table 8.

TABLE 8

| Item | Comparative method | Method A | Method B | Method C | Method D |
|---|---|---|---|---|---|
| (2) Color (APHA) | 350 | 250 | 200 | 190 | 150 |
| (3) Heat color stability (Gardner) | 6 | 5 | 4–5 | 2–3 | 2 |
| (4) Thermal oxidation color stability (Gardner) | 7 | 5–6 | 5 | 3 | 2 |
| (5) Base color stability (Gardner) | 10 | 9 | 7–8 | 3 | 2–3 |
| (6) Acid color stability (Gardner) | 13 | 11–12 | 11 | 7 | 5–6 |

EXAMPLE 5

To commercial paraffin oxidation fatty acid, which was a mixture of fatty acids having 5–9 carbon atoms and had a neutralization value of 427.3 and an iodine value of 6.7, were added 0.5% of aluminum-zinc alloy powder, 0.2% of triphenyl borate, 0.1% of 2,4-bis(n-octylthio)-6-(4-hydroxy-3,5-di-t-butylanilino)-1,3,5-triazine and 0.2% of a hydrogenation catalyst of copper chromite, and the resulting mixture was stirred at 150° C. for 3 hours under a hydrogen pressure of 5 kg/cm$^2$. The reaction mass was filtered, and the filtrate was distilled to obtain hydrogenated paraffin oxidation fatty acid according to Method D of the present invention.

Further, the same commercial paraffin oxidation fatty acid as described above was treated in the same manner as described above, except that the commercial paraffin oxidation fatty acid was hydrogenated in the presence of 0.2% of copper chromite alone as Comparative method, in the presence of 0.2% of copper chromite and 0.5% of aluminum-zinc alloy powder as Method A, in the presence of 0.2% of copper chromite, 0.5% of aluminum-zinc alloy powder and 0.2% of triphenyl borate as Method B, and in the presence of 0.2% of copper chromite, 0.5% of aluminum-zinc alloy powder and 0.1% of 2,4-bis(n-octylthio)-6-(4-hydroxy-3,5-di-t-butylanilino)-1,3,5-triazine as Method C, to obtain hydrogenated paraffin oxidation fatty acids.

The analytical data and the result of stability test of the resulting hydrogenated paraffin oxidation fatty acids are shown in the following Table 9.

TABLE 9

| Item | Comparative method | Method A | Method B | Method C | Method D |
|---|---|---|---|---|---|
| (1) Iodine value (Wijs) | 4.3 | 4.2 | 4.2 | 4.1 | 4.2 |
| (2) Color (APHA) | 90 | 50 | 30 | 50 | 30 |
| (3) Heat color stability (APHA) | 250 | 130 | 90 | 120 | 80 |
| (4) Thermal oxidation color stability (APHA) | 450 | 200 | 160 | 190 | 140 |
| (5) Base color stability | 7 | 5 | 4 | 5 | 3–4 |

TABLE 9-continued

| Item | Comparative method | Method A | Method B | Method C | Method D |
|---|---|---|---|---|---|
| (Gardner) | | | | | |
| (6) Acid color stability (Gardner) | 6 | 4–5 | 4 | 4 | 3–4 |
| (7) Oxidation stability (POV) | 20.3 | 19.6 | 19.7 | 1.7 | 1.6 |

Further, 200 g of each of the above obtained hydrogenated paraffin oxidation fatty acids was charged in a 500 ml beaker and thermally deteriorated for 10 days in an oven kept at 80° C. The above treated fatty acids were subjected to the same stability tests as described above, and the obtained result is shown in the following Table 10.

TABLE 10

| Item | Comparative method | Method A | Method B | Method C | Method D |
|---|---|---|---|---|---|
| (2) Color (APHA) | 250 | 170 | 120 | 110 | 80 |
| (3) Heat color stability (Gardner) | 5 | 4 | 3–4 | 2 | 1 |
| (4) Thermal oxidation color stability (Gardner) | 7 | 5–6 | 5 | 2–3 | 1–2 |
| (5) Base color stability (Gardner) | 13 | 11 | 10 | 6 | 4–5 |
| (6) Acid color stability (Gardner) | 12 | 10–11 | 9 | 6 | 5 |

EXAMPLE 6

To crude beef tallow fatty acid having a neutralization value of 200.7 and an iodine value of 50.2 were added 0.2% of magnesium powder, 0.1% of zinc borate, 0.3% of tetrakis[methylene(3,4-di-t-butyl-4-hydroxyhydrocinnamate)]methane and 0.2% of a hydrogenation catalyst of nickel-hardened fat, and the resulting mixture was stirred at 150° C. for 2 hours under a hydrogen pressure of 1 kg/cm$^2$. The reaction mass was filtered, and the filtrate was distilled to obtain partially hydrogenated beef tallow fatty acid according to Method D of the present invention.

Further, the same crude beef tallow fatty acid as described above was treated in the same manner as described above, except that the crude beef tallow fatty acid was hydrogenated in the presence of 0.2% of nickel-hardened fat alone as Comparative method, in the presence of 0.2% of nickel-hardened fat and 0.2% of magnesium powder as Method A, in the presence of 0.2% of nickel-hardened fat, 0.2% of magnesium powder and 0.1% of zinc borate as Method B, and in the presence of 0.2% of nickel-hardened fat, 0.2% of magnesium powder and 0.3% of tetrakis[methylene(3,5-di-t-butyl-4-hydroxyhydrocinnamate)]methane as Method C, to obtain partially hydrogenated beef tallow fatty acids.

The analytical data and the result of stability test of the resulting partially hydrogenated beef tallow fatty acids are shown in the following Table 11.

TABLE 11

| Item | Comparative method | Method A | Method B | Method C | Method D |
|---|---|---|---|---|---|
| (1) Iodine value (Wijs) | 40.2 | 39.6 | 40.0 | 39.8 | 39.7 |
| (2) Color (APHA) | 170 | 120 | 80 | 110 | 80 |
| (3) Heat color stability (APHA) | 250 | 170 | 130 | 160 | 120 |
| (4) Thermal oxidation color stability (Gardner) | 4 | 3 | 2–3 | 3 | 2 |
| (5) Base color stability (Gardner) | 4 | 3 | 2–3 | 2–3 | 2 |
| (6) Acid color stability (Gardner) | 6 | 5 | 4 | 4 | 3–4 |
| (7) Oxidation stability (POV) | 28.4 | 27.6 | 26.5 | 4.2 | 3.5 |

Further, 200 g of each of the above obtained partially hydrogenated beef tallow fatty acids was charged in a 500 ml beaker and thermally deteriorated for 10 days in an oven kept at 80° C. The above treated fatty acids were subjected to the same stability tests as described above, and the obtained result is shown in the following Table 12.

TABLE 12

| Item | Comparative method | Method A | Method B | Method C | Method D |
|---|---|---|---|---|---|
| (2) Color (Gardner) | 5 | 4 | 3–4 | 3 | 2–3 |
| (3) Heat color stability (Gardner) | 10 | 9 | 8–9 | 6 | 5 |
| (4) Thermal oxidation color stability (Gardner) | 9 | 8 | 7 | 5 | 4 |
| (5) Base color stability (Gardner) | 12 | 11 | 10 | 6 | 5 |
| (6) Acid color stability | 15 | 13–14 | 13 | 8–9 | 7 |

TABLE 12-continued

| Item | Comparative method | Method A | Method B | Method C | Method D |
|---|---|---|---|---|---|
| (Gardner) | | | | | |

It can be seen from the results of the above described experiments that the hydrogenated fatty acid obtained by the method of the present invention is very excellent in the color and stability.

What is claimed is:

1. A method of producing hydrogenated fatty acids comprising hydrogenating a fatty acid, oil or fat in the presence of a hydrogenation catalyst, a reducing metal and a boric acid compound, and distilling the crude hydrogenated fatty acid; or splitting the hydrogenated oil or fat into a crude hydrogenated fatty acid, and distilling the crude hydrogenated fatty acid.

2. A method according to claim 1, wherein the hydrogenation is carried out in the presence of a hydrogenation catalyst, a reducing metal, a boric acid compound and a heavy phenolic compound.

3. A method of producing hydrogenated fatty acids, comprising hydrogenating a fatty acid, oil or fat in the presence of a hydrogenation catalyst, a reducing metal and a heavy phenolic compound, and distilling the crude hydrogenated fatty acid; or splitting the hydrogenated oil or fat into a crude hydrogenated fatty acid, and distilling the crude hydrogenated fatty acid.

4. A method according to claim 1, 2, or 3, wherein the hydrogenation catalyst is iron, cobalt, nickel, ruthenium, rhodium, palladium, osmium, irridium, platinum, chromium, molybdenum, tungsten, copper, rhenium, vanadium, or an alloy, oxide, hydroxide or sulfide of these metals.

5. A method according to claim 1, 2 or 3, wherein the reducing metal is magnesium, calcium, aluminum, zinc, tin or an alloy of these metals.

6. A method according to claim 1 or 2, wherein the boric acid compound is orthoboric acid, metaboric acid, tetraboric acid, boron oxide or an ester or salt of these boric acids.

7. A method according to claim 2 or 3, wherein the heavy phenolic compound is a heat resistant heavy phenolic compound having a boiling point higher than that of the hydrogenated fatty acid.

8. A method according to claim 1, 2 or 3, wherein the amount of the hydrogenation catalyst is 0.01–5% by weight and that of the reducing metal is 0.01–2% by weight based on the amount of raw fatty acid, oil or fat.

9. A method according to claim 1 or 2, wherein the amount of the boric acid compound is 0.01–2% by weight based on the amount of raw fatty acid, oil or fat.

10. A method according to claim 2 or 3, wherein the amount of the heavy phenolic compound is 0.001–1.0% by weight based on the amount of raw fatty acid, oil or fat.

* * * * *